US009238968B2

(12) United States Patent
Harding et al.

(10) Patent No.: US 9,238,968 B2
(45) Date of Patent: Jan. 19, 2016

(54) VANE

(75) Inventors: Adrian L Harding, Derby (GB); Thomas Randles, Uttoxeter (GB); John H Brookhouse, Loughborough (GB)

(73) Assignee: ROLLS-ROYCE plc, London (GB)

( * ) Notice: Subject to any disclaimer, the term of this patent is extended or adjusted under 35 U.S.C. 154(b) by 1001 days.

(21) Appl. No.: 13/404,320

(22) Filed: Feb. 24, 2012

(65) Prior Publication Data

US 2012/0219402 A1 Aug. 30, 2012

(30) Foreign Application Priority Data

Feb. 28, 2011 (GB) ..... 1103317.2

(51) Int. Cl.
*F01D 5/18* (2006.01)

(52) U.S. Cl.
CPC ..... *F01D 5/189* (2013.01); *F05D 2240/122* (2013.01); *F05D 2240/55* (2013.01); *F05D 2260/201* (2013.01); *F05D 2260/30* (2013.01)

(58) Field of Classification Search
CPC ..... F01D 5/188; F01D 5/189; F01D 9/06; F01D 9/065
See application file for complete search history.

(56) References Cited

U.S. PATENT DOCUMENTS

| | | | | |
|---|---|---|---|---|
| 4,437,810 | A * | 3/1984 | Pearce | 415/115 |
| 6,450,759 | B1 * | 9/2002 | Miller et al. | 415/115 |
| 2006/0120869 | A1 | 6/2006 | Wilson et al. | |

FOREIGN PATENT DOCUMENTS

| | | | |
|---|---|---|---|
| EP | 1 674 660 | A2 | 6/2006 |
| GB | 2 350 867 | A | 12/2000 |
| GB | 2 386 926 | A | 10/2003 |

OTHER PUBLICATIONS

Jun. 2, 2011 Search Report issued in British Patent Application No. 1103317.2.

* cited by examiner

*Primary Examiner* — Craig Kim
*Assistant Examiner* — Jason Davis
(74) *Attorney, Agent, or Firm* — Oliff PLC

(57) ABSTRACT

A vane is provided for directing hot gases in a gas turbine engine. The vane includes a hollow aerofoil portion, which in use spans the working gas annulus of the engine. The vane further includes an impingement tube which forms a covering over the interior surface of the aerofoil portion and which has jet-forming apertures formed therein for the production of impingement cooling jets. The impingement tube includes two tube portions which are separately insertable into position into the aerofoil portion to form the covering. The impingement tube further includes an expansion member which, when the tube portions are in position in the aerofoil portion, is locatable in the aerofoil portion to urge each tube portion outwardly and thereby holds the tube portions in position against the aerofoil portion.

11 Claims, 6 Drawing Sheets

VANE

The present invention relates to a vane for directing hot gases in a gas turbine engine.

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 14 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

A row of static nozzle guide vanes (NGVs) mounted into the turbine casing is provided at the entrance to each of the high, intermediate and low-pressure turbines 16, 17, 18. The NGVs are shaped to swirl the gasflow in the direction of rotation of the following rotor blades, and thereby to convert part of the gasflow's heat and pressure energy into kinetic energy from which the rotor blades can generate power. The NGVs of particularly the high and intermediate-pressure turbines 16, 17 tend to be cooled in order to withstand the high temperatures to which they are exposed.

Impingement cooling is typically used to cool intermediate-pressure NGVs. A conventional impingement tube 26 is inserted into the hollow NGV, as shown in FIG. 2, which is a schematic cross-section through an intermediate-pressure NGV 25, the cross-section containing the leading 27 and trailing 28 edges of the NGV. The tapered shape of the internal cavity of the NGV allows the tube to be inserted along an approximately radial direction R of the engine. In FIG. 2, the tube is shown in both its pre-inserted and fully inserted positions. Once inserted, the tube is fixed at both ends, e.g. by welding at one end and swaging at the other. The swaged end of the NGV can be configured to allow relative radial movement between that end and the casing so that differential thermal expansion/contraction effects can be accommodated. Ribs on the inner surface of the NGV walls space the tube from therefrom. Apertures are formed in the tube, predominantly in the leading edge region, but also optionally along the pressure and suction sides of the NGV. Cooling air enters the tube from either or both of its ends, forms jets as it passes through the apertures, and then impinges on the walls of the NGV to penetrate the surface boundary layer and provide effective cooling. The air then flows away in the space between the walls of the NGV and the tube, to exit the NGV at holes or a slot formed along its trailing edge.

An impingement cooling scheme of this type can provide effective cooling, while also leaving the internal space of the impingement tube 26 free to carry e.g. support struts for supporting engine bearing structures, and engine oil and air feeds.

NGV aerofoil shapes are becoming, however, increasingly complex. For example, FIG. 3 shows schematically (a) a cross-section through another intermediate-pressure NGV 29, the cross-section being transversely across the engine and intersecting the suction 30 and pressure 31 sides of the NGV, and (b) a different cross-section containing the leading 32 and trailing 33 edges of the same NGV. The cross-sections show the NGV to have a re-entrant internal cavity feature 34 that would prevent insertion of a conventional impingement tube in the manner described above.

An aim of the present invention is to provide a vane including an impingement tube which can inserted into the vane even when the vane has a re-entrant internal cavity feature.

Accordingly, a first aspect of the present invention provides a vane for directing hot gases in a gas turbine engine, the vane including:

a hollow aerofoil portion, which in use spans the working gas annulus of the engine, and an impingement tube which forms a covering over the interior surface of the aerofoil portion and which has jet-forming apertures formed therein for the production of impingement cooling jets;

wherein the impingement tube includes two tube portions which are separately insertable into position into the aerofoil portion to form the covering, and an expansion member which, when the tube portions are in position in the aerofoil portion, is locatable in the aerofoil portion to urge each tube portion outwardly and thereby holds the tube portions in position against the aerofoil portion.

Advantageously, by dividing the impingement tube into separate tube portions, each tube portion be configured such that it is possible to be positioned in the cavity of the aerofoil portion, even when that cavity has a re-entrant feature. The expansion member then holds the tube portions in position.

The vane may have any one or, to the extent that they are compatible, any combination of the following optional features.

Typically, one of the tube portions is positioned forward in the aerofoil portion and the other tube portion is positioned rearward in the aerofoil portion. For example the forward portion can wrap around the inside of the leading edge of the aerofoil portion, and the rearward portion can wrap around the inside of the trailing edge.

Either or both of the tube portions may be resiliently deformable to facilitate its insertion into the aerofoil portion. For example, the or each tube portions can be pinched inwardly to reduce its width on insertion into the aerofoil portion, and then allowed to resile outwardly to regain its shape after insertion.

Typically, the expansion member urges the tube portions outwardly against the pressure surface side and the suction surface side of the aerofoil portion. The aerofoil portion typically has a plurality of projections and/or ridges on the internal surface against which the tube portions are held, the projections and/or ridges setting up a space between the impingement tube and the aerofoil portion through which the air from the cooling jets can flow.

The outward urging can be achieved in various ways. One option is for expansion member to be slidably insertable into the aerofoil portion to urge the positioned tube portions outwardly with a wedging action. Another option is for expansion member to be rotatably connected to one of the tube portions to urge the positioned tube portions outwardly with a camming action.

Preferably the expansion member and the tube portions have complimentary engaging formations which retain the expansion member in its location to urge the tube portions outwardly. In this way, inadvertent loss of the expansion member from the aerofoil portion, and hence loosening of the tube portions can be avoided.

Preferably, the expansion member is removably locatable in the aerofoil portion. This allows the tube portions also to be removably positionable so that they can be replaced if necessary.

The tube portions may have seal formations at which the tube portions sealingly join to each other. Such formations help to prevent cooling air leaking through the joins between the tube portions and by-passing the jet-forming apertures. The expansion member can conveniently urge the tube portions outwardly at the seal formations. In this way, outward pressure from the expansion member can help to perfect the seals made by the seal formations.

The expansion member may be a bimetallic strip. This can help the member to expand and contract with expansion and contraction of the aerofoil portion, maintaining the outward urging on the tube portions.

The expansion member may be a compression spring which presses on the tube portions to urge them outwardly.

Typically there are only two tube portions. This allows the outward expansion of the tube portions to be performed by only one expansion member, helping to maintain the amount of available space inside the impingement tube for e.g. engine support structures and fluid feeds. However, it is possible for the impingement tube to include more than two tube portions which are separately insertable into position in the aerofoil portion to form the covering, and a plurality of expansion members which, when the tube portions are in position in the aerofoil portion, are locatable in the aerofoil portion to urge each tube portion outwardly and thereby holds the tube portions in position against the aerofoil portion.

Typically, the vane is a nozzle guide vane, e.g. an intermediate turbine nozzle guide vane.

Typically, the vane has a re-entrant internal cavity feature which would prevent a one-piece impingement tube from being inserted therein.

A second aspect of the present invention provides an impingement tube suitable for use in the vane of any one of the first aspect.

Embodiments of the invention will now be described by way of example with reference to the accompanying drawings in which.

Figure 11:
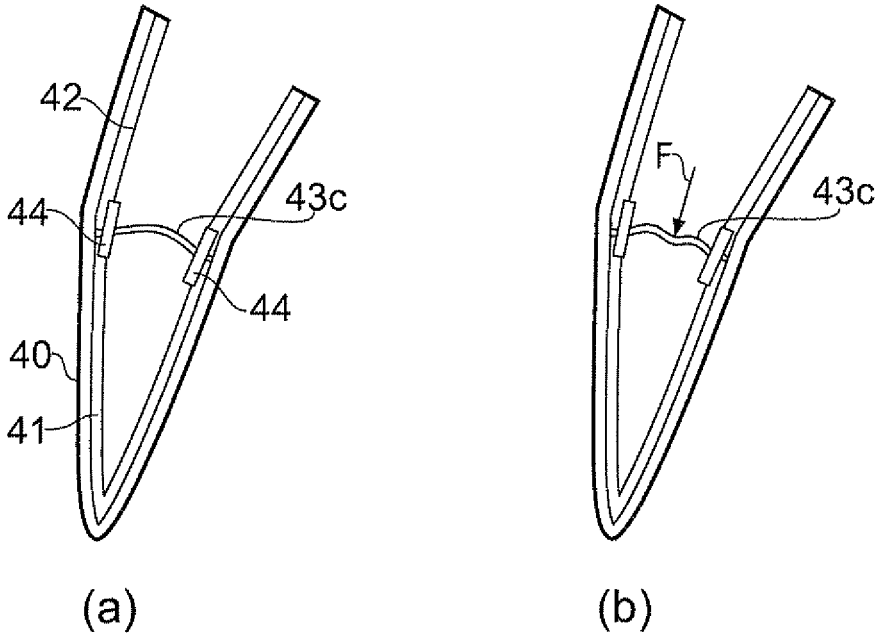
Figure 12:
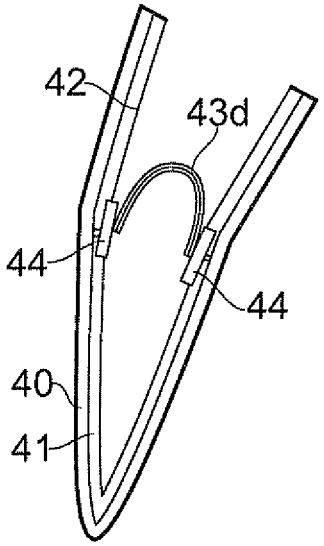

FIGS. 11(*a*) and 11(*b*) show schematically the rearward part of an aerofoil section of the aerofoil portion and another possible form for the expansion member (a) after insertion and (b) after subsequent deformation so that the member acts as a compression spring; and FIG. 12 shows schematically the rearward part of an aerofoil section of the aerofoil portion and another possible form for the expansion member.

Figure 1:
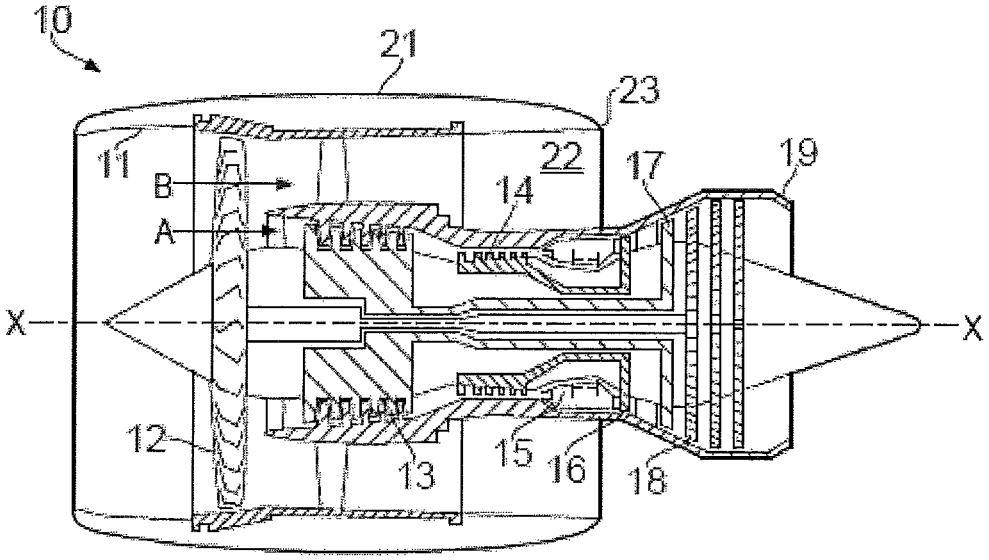
FIG. 1 (PRIOR ART)
FIG. 1 shows a schematic longitudinal cross-section through a ducted fan gas turbine engine.
Figure 2:
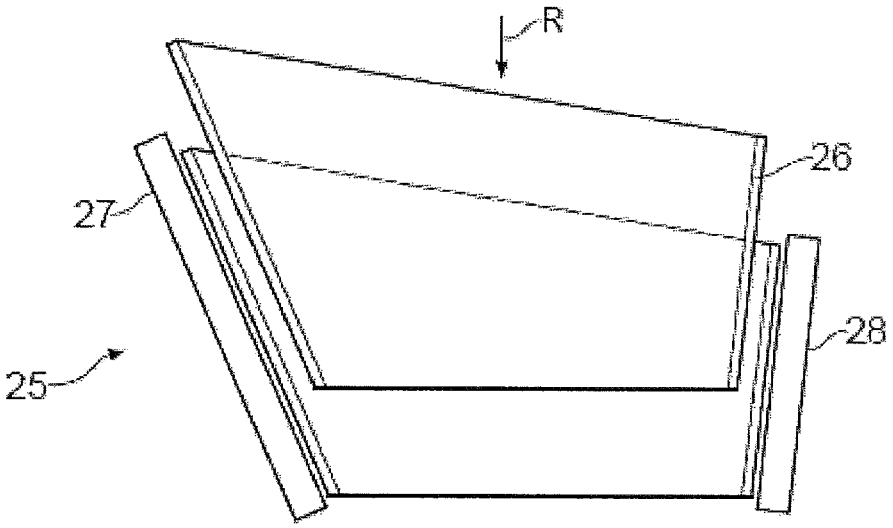
FIG. 2 (PRIOR ART)
FIG. 2 shows a schematic cross-section through an intermediate-pressure NGV.
Figure 3:
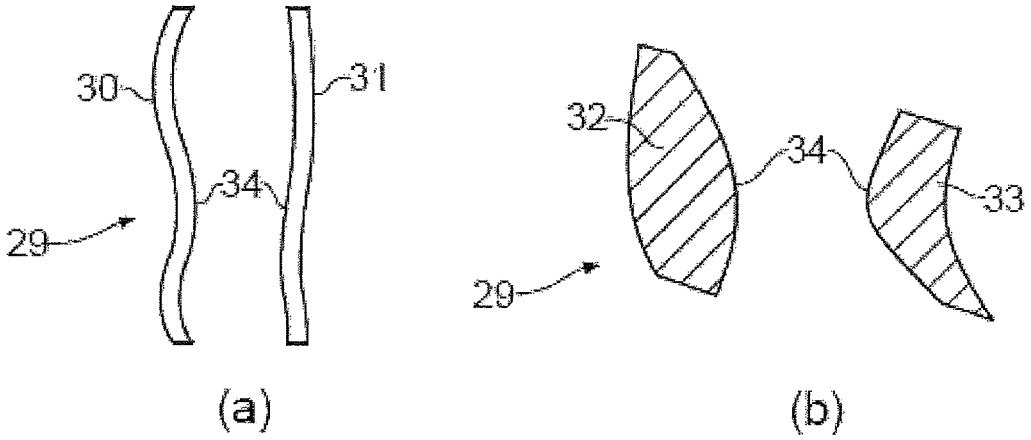
FIG. 3 (PRIOR ART)
FIG. 3 shows schematically (a) a cross-section through another intermediate-pressure NGV, the cross-section being transversely across the engine and intersecting the suction and pressure sides of the NGV, and (b) a different cross-section containing the leading and trailing edges of the same NGV.
Figure 4:
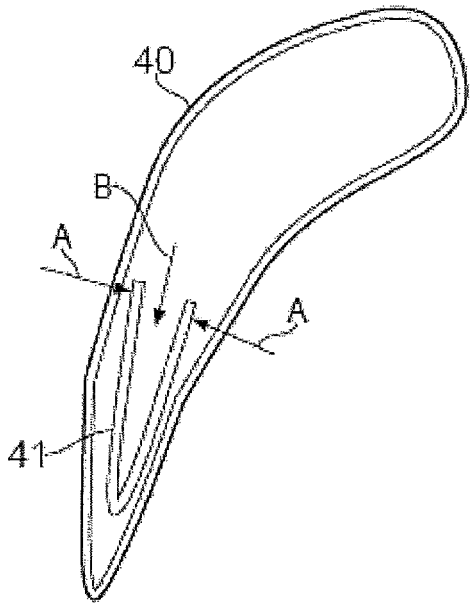
FIGS. 4 to 6 show an aerofoil section through the aerofoil portion of an NGV and successive steps in the fitting of an impingement tube therein.
Figure 5:
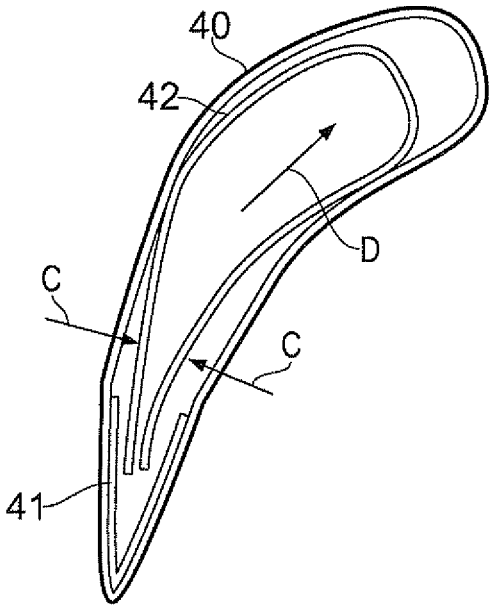
Figure 6:
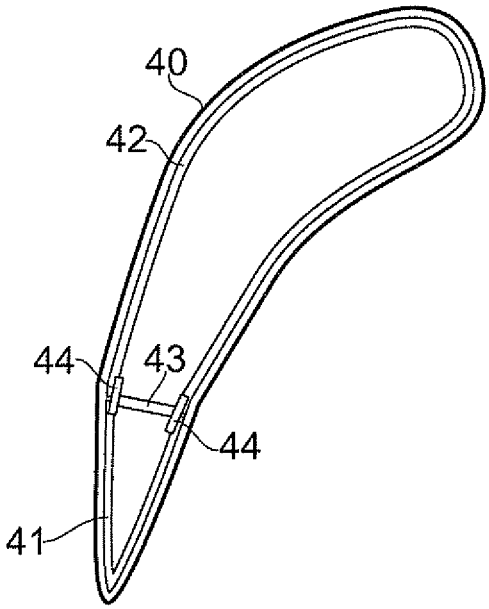

FIGS. 4 to 6 show an aerofoil section through the aerofoil portion 40 of an NGV and successive steps in the fitting of an impingement tube therein. The aerofoil portion has a re-entrant internal cavity feature which prevents a one-piece impingement tube from being inserted therein. Instead, therefore, an impingement tube formed from two tube portions is fitted. As shown in FIG. 4, firstly the rearward tube portion 41 is inserted into the cavity of the aerofoil portion. The tube portion is V-shaped on the chordal section and can be resiliently deformed under inward compression to pinch the V (indicated by arrows A), thereby facilitating passage of the tube portion into the cavity. The tube portion is then slid (indicated by arrow B) rearwardly into position, the inward compression released, and the tube portion resiles outwardly to fit against gap-forming ridges and/or projections (not shown) formed on the inner surface of the rear part of the aerofoil portion.

Next, as shown in FIG. 5, the forward tube portion 42 is inserted into the cavity. This tube portion is U-shaped on the chordal section and can also be resiliently deformed under inward compression to pinch the U (indicated by arrows C), again facilitating passage of the tube portion into the cavity. The tube portion is then slid (indicated by arrow D) forwardly into position, the inward compression released, and the tube portion resiles outwardly to fit against gap-forming ridges and/or projections (not shown) formed on the inner surface of the forward part of the aerofoil portion 40.

Figure 7:
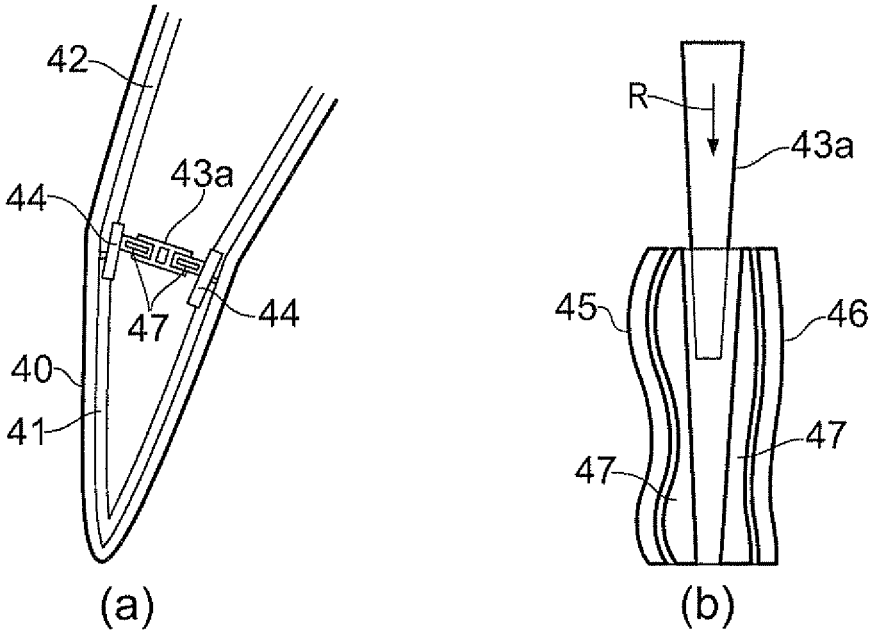
FIG. 7 shows schematically (a) an expansion member fitted in the rearward part of an aerofoil section of the aerofoil portion, and (b) a cross-section transversely across the engine and intersecting the expansion member and the suction and pressure sides of the aerofoil portion.

Subsequently, as shown in FIG. 6, to hold the tube portions 41, 42 in position against the aerofoil portion 40, an expansion member 43 is located in the aerofoil portion and urges each tube portion outwardly against facing parts of the pressure and suction side walls of the aerofoil portion. Sealing strips 44 which extend along the joins between the rearward 41 and forward 42 tube portions prevent cooling air leakage through joins, the seals being perfected by outward pressure exerted on them by the expansion member. The sealing strips may be fitted at the same time as the expansion member, or they may be integral or previously attached (e.g. brazed or welded on) parts of the tube portions FIGS. 7(*a*) and (*b*) shows schematically a possible form for the expansion member 43*a*, FIG. 7(*a*) being the rearward part of an aerofoil section of the aerofoil portion 40, and FIG. 7(*b*) being a cross-section transversely across the engine and intersecting the expansion member and the suction 45 and pressure 46 sides of the aerofoil portion. The expansion member is slidably inserted into the aerofoil portion along an approximately radial direction R of the engine. The member tapers from one end to the other so that it urges both tube portions outwardly at the sealing strips 44 against the aerofoil portion with a wedging action. Guide members 47 projecting inwardly from the sealing strips keep the expansion member aligned with the sealing strips as it is inserted. To keep the expansion member in place after insertion, it can be brazed or welded to the tube portions or the NGV. Alternatively, complimentary mechanical engaging formations can be formed on the expansion member and the tube portions or the NGV which retain the member in place and preferably allow the member and (subsequently the tube portions) to be removed from the aerofoil portion.

Figure 8:
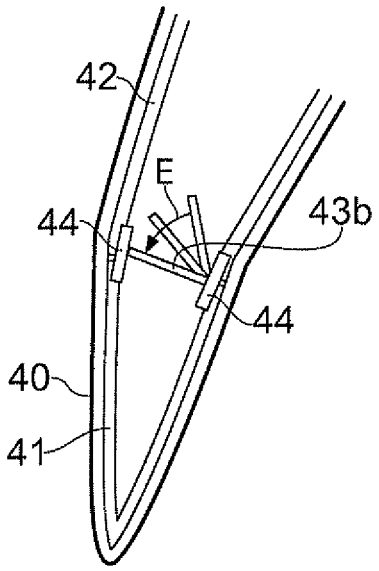
FIG. 8 shows schematically another expansion member fitted in the rearward part of an aerofoil section of the aerofoil portion.

FIG. 8 shows schematically the rearward part of an aerofoil section of the aerofoil portion 40 and another possible form for the expansion member 43*b*. In this case, the expansion member is rotatably connected along one edge to one of the sealing strips 44. After insertion of the tube portions 41, 42, the member is rotated, as indicated by the arrow E, so that its opposite edge engages with the opposite sealing strip and urges both tube portions outwardly against the aerofoil portion with a camming action.

Figure 9:
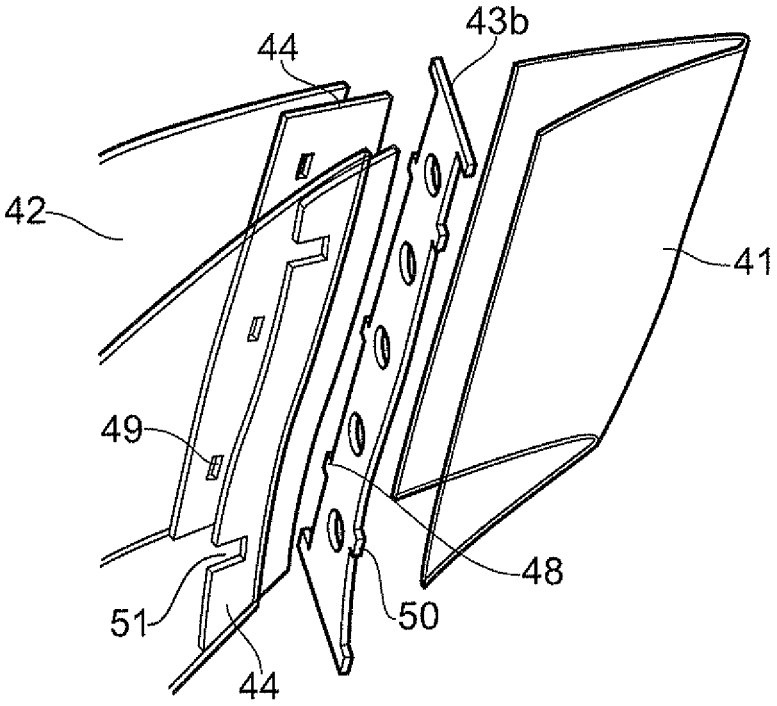
FIG. 9 shows a detailed exploded perspective view of the assembly of the expansion member of FIG. 8 and the rearward part of the impingement tube (without the aerofoil portion)
Figure 10:
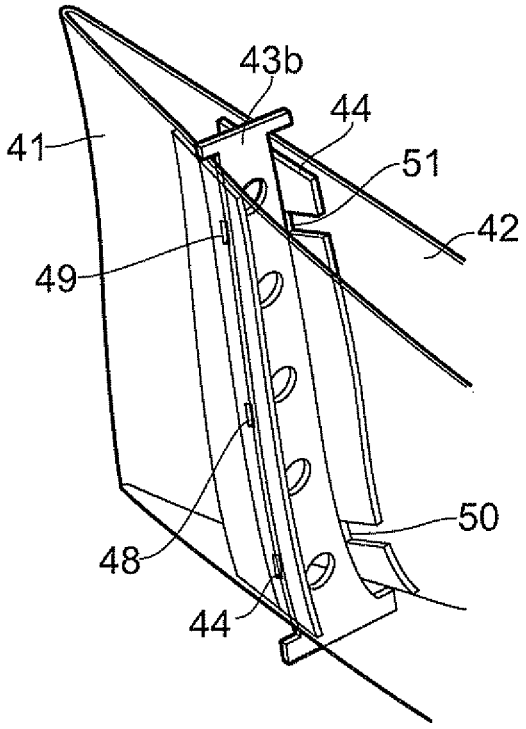
FIG. 10 shows a detailed perspective view of the rotatable expansion member of FIG. 8 and the rearward part of the impingement tube (without the aerofoil portion) with the member rotated into location.

FIG. 9 shows a detailed exploded perspective view of the assembly of the rotatable expansion member 43*b* and the rearward part of the impingement tube (without the aerofoil portion 40), and FIG. 10 shows a detailed perspective view of the rotatable expansion member 43 and the rearward part of the impingement tube (again without the aerofoil portion) with the member rotated into location. Tangs 48 along the one side of the member fit into corresponding recesses 49 in one of the sealing strips 44 and allow the member to rotate about that the strip at that side. Tangs 50 along the other side of the member then fit into receiving slots 51 on the other sealing strip after the rotation of the member. The tangs, recess and slots provide complimentary engaging formations which retain the member in its location to urge the tube portions outwardly.

FIGS. 11(*a*) and (*b*) shows schematically the rearward part of an aerofoil section of the aerofoil portion 40 and another possible form for the expansion member 43*c*. The member, when initially located between the sealing strips 44 has a C-shaped cross-section, as shown in FIG. 11(*a*). The member is then deformed (as indicated by arrow F) into a W-shaped cross-section, as shown in FIG. 11(*b*). The member thus acts as compression spring which presses on the tube portions 41, 42 to urge them outwardly.

FIG. 12 shows schematically the rearward part of an aerofoil section of the aerofoil portion 40 and another possible form for the expansion member 43*d*. The member has a C-shaped cross-section and acts as compression spring pressing on the tube portions 41, 42 to urge them outwardly. However, the member is formed from a bimetallic strip which is configured to expand and contract with expansion and contraction of the aerofoil portion. In this way, the outward urging on the tube portions 41, 42 by the member can be maintained at different temperatures.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A vane for directing hot gases in a gas turbine engine, the vane including:

a hollow aerofoil portion, which in use spans the working gas annulus of the engine, and an impingement tube which forms a covering over the interior surface of the aerofoil portion and which has jet-forming apertures formed therein for the production of impingement cooling jets;

wherein the impingement tube includes two tube portions which are separately insertable into position into the aerofoil portion to form the covering, one of the tube portions is positioned forward in the aerofoil portion and the other tube portion is positioned rearward in the aerofoil portion, and an expansion member which, when the tube portions are in position in the aerofoil portion, is locatable in the aerofoil portion to urge each tube portion outwardly and thereby holds the tube portions in position against the aerofoil portion.

2. A vane according to claim 1, wherein either or both of the tube portions is resiliently deformable to facilitate its insertion into the aerofoil portion.

3. A vane according to claim 1, wherein the expansion member urges the tube portions outwardly against the pressure surface side and the suction surface side of the aerofoil portion.

4. A vane according to claim 1, wherein the expansion member is slidably insertable into the aerofoil portion to urge the positioned tube portions outwardly with a wedging action.

5. A vane according to claim 1, wherein the expansion member is rotatably connected to one of the tube portions to urge the positioned tube portions outwardly with a camming action.

6. A vane according to claim 1, wherein the expansion member is removably locatable in the aerofoil portion.

7. A vane according to claim 1, wherein the tube portions have seal formations at which the tube portions sealingly join to each other.

8. A vane according to claim 7, wherein the expansion member urges the tube portions outwardly at the seal formations.

9. A vane according to claim 1, wherein the expansion member is a bimetallic strip.

10. A vane according to claim 1, wherein the expansion member is a compression spring which presses on the tube portions to urge them outwardly.

11. An impingement tube suitable for use in the vane of claim 1 wherein the impingement tube includes two tube portions which are separately insertable into position into the aerofoil portion to form the covering, one of the tube portions is configured for positioning forward in the aerofoil portion and the other tube portion is configured for positioning rearward in the aerofoil portion, and an expansion member which, when the tube portions are in position in the aerofoil portion, is locatable in the aerofoil portion to urge each tube portion outwardly and thereby holds the tube portions in position against the aerofoil portion.

* * * * *